US007996183B2

(12) United States Patent
Takeda et al.

(10) Patent No.: US 7,996,183 B2
(45) Date of Patent: Aug. 9, 2011

(54) PERFORMANCE MONITORING APPARATUS AND SYSTEM FOR FLUID MACHINERY

(75) Inventors: Kazuhiro Takeda, Hiroshima (JP); Shinji Ogino, Mihara (JP); Kazuko Takeshita, Horoshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 371 days.

(21) Appl. No.: 12/297,236

(22) PCT Filed: Apr. 18, 2006

(86) PCT No.: PCT/JP2006/308129

§ 371 (c)(1),
(2), (4) Date: Oct. 15, 2008

(87) PCT Pub. No.: WO2007/122697

PCT Pub. Date: Nov. 1, 2007

(65) Prior Publication Data

US 2009/0150121 A1 Jun. 11, 2009

(51) Int. Cl.
*G06F 11/30* (2006.01)

(52) U.S. Cl. ..... 702/184; 702/182; 702/183; 702/185; 702/33; 702/34

(58) Field of Classification Search ..... 702/184
See application file for complete search history.

(56) References Cited

U.S. PATENT DOCUMENTS

| | | | | |
|---|---|---|---|---|
| 4,156,578 | A * | 5/1979 | Agar et al. | 415/1 |
| 6,853,951 | B2 * | 2/2005 | Jarrell et al. | 702/181 |
| 2002/0094267 | A1 * | 7/2002 | Kim et al. | 415/118 |
| 2003/0077179 | A1 * | 4/2003 | Collins et al. | 417/63 |

FOREIGN PATENT DOCUMENTS

| | | | |
|---|---|---|---|
| JP | 59162395 | A | 9/1984 |
| JP | 08-247076 | A | 9/1996 |
| JP | 2003028076 | A | 1/2003 |
| JP | 2003-166477 | A | 6/2003 |
| JP | 2006125275 | A | 5/2006 |

OTHER PUBLICATIONS

ISR for PCT/JP2006/308129 dated Jul. 18, 2006.

* cited by examiner

*Primary Examiner* — Jonathan C Teixeira Moffat
*Assistant Examiner* — Hyun Park
(74) *Attorney, Agent, or Firm* — Kanesaka Berner & Partners

(57) ABSTRACT

A performance monitoring apparatus for a fluid machinery which includes a predicted performance curve calculator for obtaining a curve representing the relationship between a pressure coefficient and a flow coefficient by non-dimensional characteristics per a plural fluid control quantities from a compression ratio or a pressure difference and an inlet flow rate of the fluid machinery, and a performance monitoring calculator for obtaining an actual performance head from fluid control quantities, a suction pressure, a discharge pressure, a suction temperature, a compression coefficient, a gas average molecular weight, and a specific heat ratio at the time of the operating fluid machinery, and obtaining a predicted performance head from a predicted performance curve, fluid control quantities, and an inlet flow rate; and calculating a performance degradation from the ratio of the predicted performance head to the actual performance head.

4 Claims, 5 Drawing Sheets

PERFORMANCE MONITORING APPARATUS AND SYSTEM FOR FLUID MACHINERY

RELATED APPLICATIONS

The present application is based on, and claims priority from, International Application Number PCT/JP2006/308129, filed Apr. 18, 2006, the disclosure of which is hereby incorporated by reference herein in its entirety.

TECHNICAL FIELD

The present invention relates to a performance monitoring apparatus and system for monitoring performance of fluid machineries, such as various fans, compressors, and pumps, for performing pneumatic transportation on fluids.

BACKGROUND ART

Conventionally, for easy monitoring of a pump by simultaneously collecting various data which are necessary to monitor performance of a pump, an apparatus provided with measurement equipment (a pressure sensor for suction pressure, a pressure sensor for discharge pressure, a thermometer for shaft seal part, a thermometer at a pump main body bearing, a thermometer at a motor bearing, a horizontal vibration sensor at a pump main body bearing, a vertical vibration sensor at a pump main body bearing, a horizontal vibration sensor at a motor bearing, a vertical vibration sensor at a motor bearing, a vibration sensor in a shaft direction, a flowmeter, and a supervision camera) having measuring terminals to be attached to predetermined locations so as to measure various data necessary for monitoring performance of the pump, and a performance monitoring recorder for collecting the measurement data and store the collected data for a preset period has been proposed (For example, Patent Document 1).

Patent Document 1: Japanese Unexamined Patent Application, First Publication No. 2003-166477 (abstract, and FIG. 1)

DISCLOSURE OF THE INVENTION

Problem to be Solved by the Invention

The conventional apparatuses only record measured data and display it with as a graph. Therefore, further analysis is needed in order for engineers to analyze performance of equipment. The apparatus is for measuring vibrations at each of the locations; therefore, it has been difficult to know performance degradation itself originated from corrosion, degradation, or the like of an impeller.

The present invention was made in view of the above-described circumstances. An objective of the invention is to provide a performance monitoring apparatus for fluid machinery or a performance monitoring system for the fluid machinery for easily monitoring the performance degradation of fluid machinery.

Means for Solving the Problem

The present invention was made in view of the above-described conventional problems. Each of the inventions described in the Claims later as a performance monitoring apparatus or system for the fluid machinery adopts the following means (1) to (4).

(1) A performance monitoring apparatus for the fluid machinery in accordance with a first means includes a predicted performance curve calculator for obtaining a curve showing the relationship between the pressure coefficient and the flow coefficient by non-dimensional characteristics per a plural fluid control quantities by using the compression ratio or the pressure difference and an input flow rate of the fluid machinery; and a performance monitoring calculator for calculating a performance degradation from a rate of a predicted performance head and a measured actual performance head. The performance monitoring calculator obtains the measured actual performance head from fluid control quantities, suction pressure, discharge pressure, suction temperature, the compression coefficient, the gas average molecular weight, and the specific heat ratio at the running time of the fluid machinery. The performance monitoring calculator obtains the predicted performance head from a predicted performance curve, the fluid control quantities, and the input flow rate.

(2) A performance monitoring apparatus for the fluid machinery in accordance with a second means is that, in the first means, the measured actual performance head $H_{real}$ is obtained by the following equation when the suction pressure is expressed as $P_s$, the discharge pressure as $P_d$, the suction temperature as $T_s$, the compression coefficient as Z, the gas average molecular weight as $M_w$, the specific heat ratio as k, and $\beta=(k-1)/k$.

$$H_{real}=Z\cdot 1/\beta\cdot T_s/M_w\cdot\{(P_d/P_s)\ \beta-1\}$$

(3) A performance monitoring apparatus for the fluid machinery in accordance with a third means is that, in the first or the second means, the performance drop rate calculator is provided for calculating the rate of change of the performance degradation by differentiating the performance degradation.

(4) A performance monitoring system for the fluid machinery in accordance with a fourth means includes a monitoring apparatus for measuring or calculating the suction pressure, the discharge pressure, the suction temperature, the compression coefficient, the gas average molecular weight, and the specific heat ratio at the running time of the fluid machinery; and a central monitoring computer for receiving the data stored in the monitoring apparatus via a network, in which the central monitoring computer is provided with a performance monitoring apparatus for the fluid machinery in accordance with any one of the first to the third means.

Effect of the Invention

Since the inventions described in the Claims employ each of the means described in the first to fourth means above, it is possible to monitor the performance degradation of the equipments very easily.

BRIEF DESCRIPTION OF THE REFERENCE NUMERALS

Figure 1:
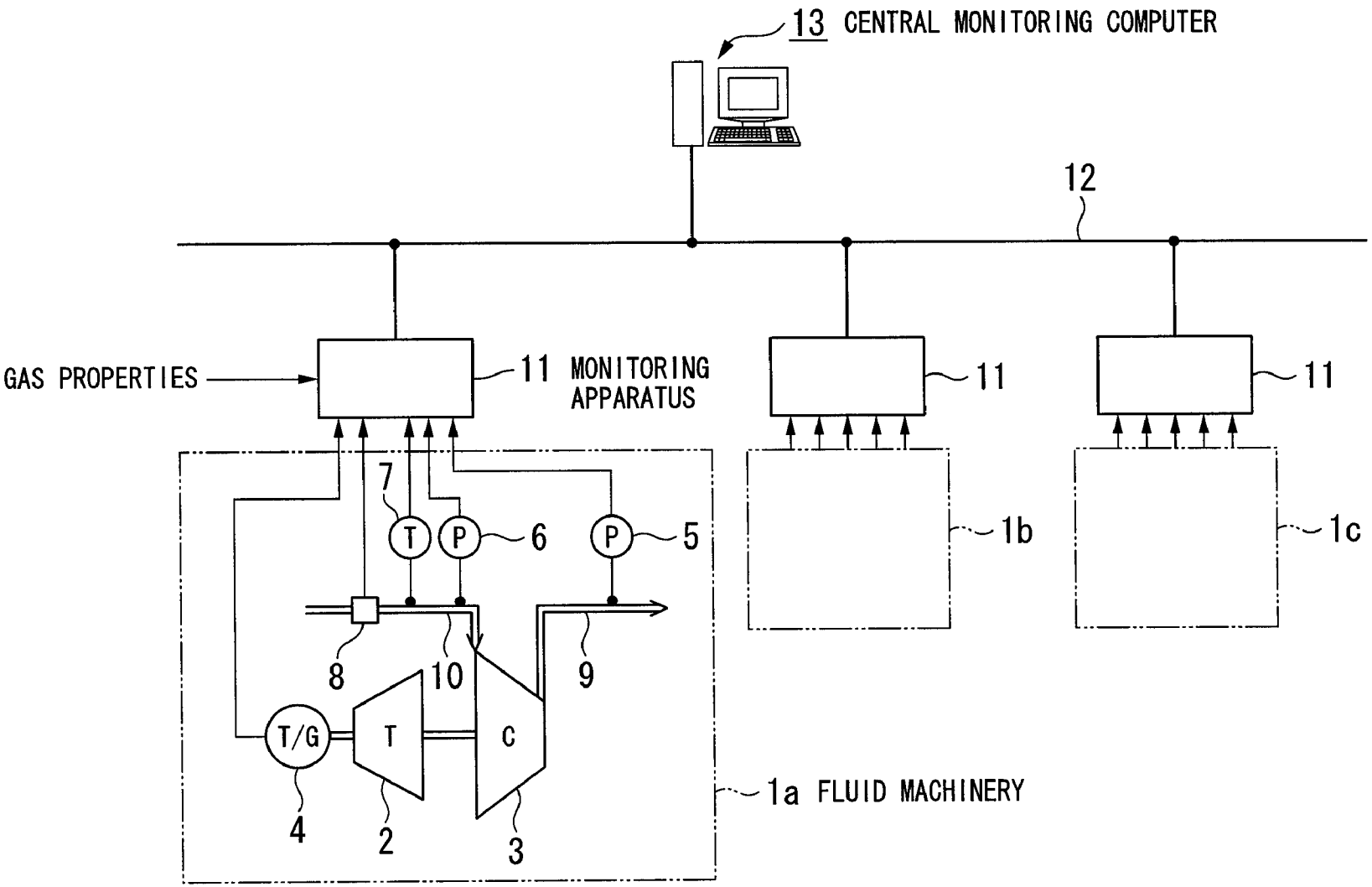
FIG. 1 is a schematic diagram of a plant adopting a performance monitoring apparatus for the fluid machinery in accordance with an embodiment of the present invention.

1*a*, 1*b*, 1*c* Fluid machinery
2 Turbine
3 Compressor
4 Speed sensor
5 Discharge pressure sensor
6 Suction pressure sensor
7 Suction thermometer
8 Flowmeter
9 Discharge pipe
10 Suction pipe
11 Monitoring apparatus
12 Network
13 Central monitoring computer
20 Operating data collector
21 Shared memory
22 Performance monitoring calculator
23 Data collection device
24 Predicted performance curve calculator
25 Performance monitoring database
26 Performance drop rate calculator
27 Historical database
28 Display device

BEST MODE FOR CARRYING OUT THE INVENTION

Embodiments of the present invention shall be described with reference to FIGS. 1 to 5.

Figure 2:
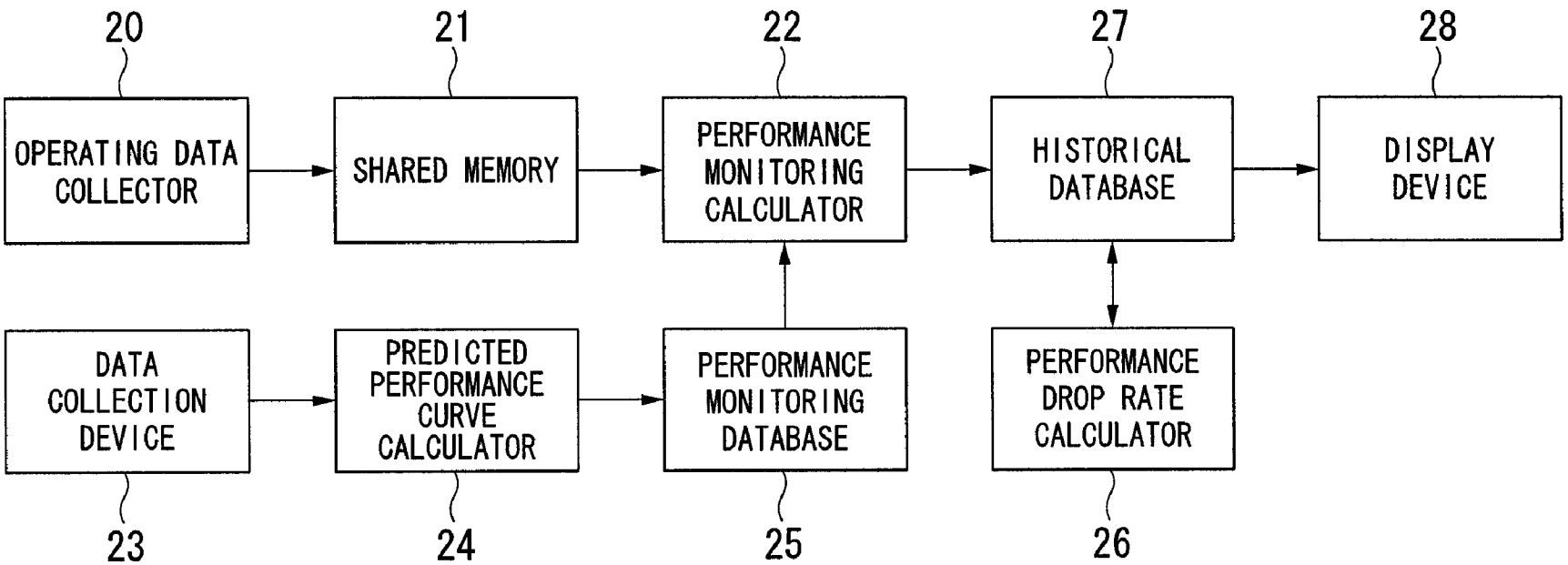
FIG. 2 is a data flow diagram of the performance monitoring apparatus for the fluid machinery in accordance with the embodiment of the present invention.
Figure 3:
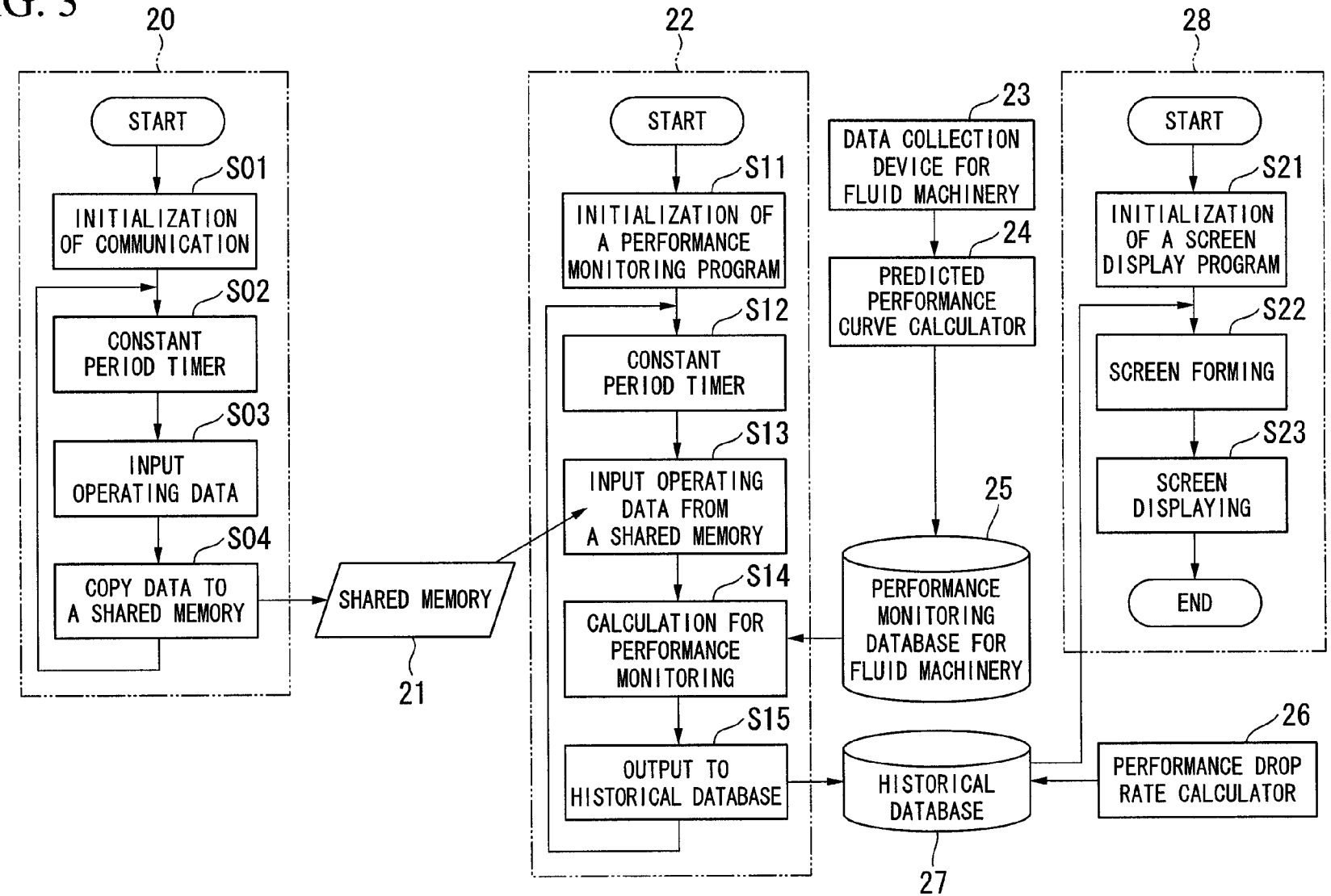
FIG. 3 is a calculation block diagram of the performance monitoring apparatus for the fluid machinery in accordance with the embodiment of the present invention.
Figure 4:
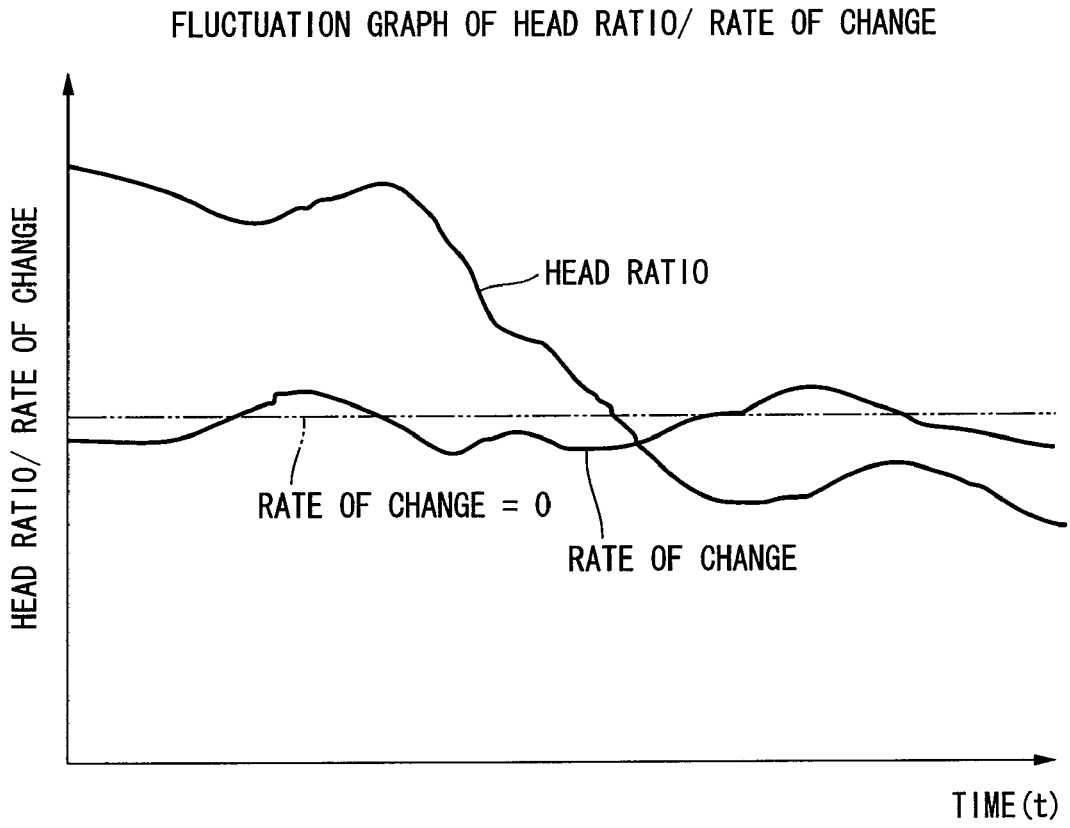
FIG. 4 is an example of a graph displayed by the performance monitoring apparatus for the fluid machinery in accordance with the embodiment of the present invention.
Figure 5A:
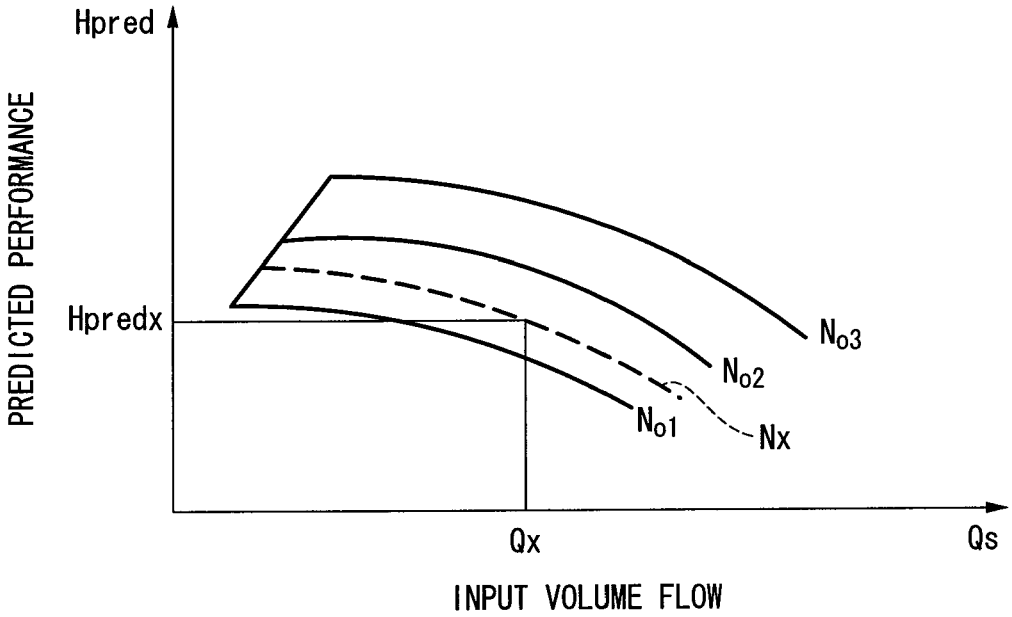
FIG. 5A shows a basic principle of a monitoring by the performance monitoring apparatus for the fluid machinery in accordance with the embodiment of the present invention.
Figure 5B:
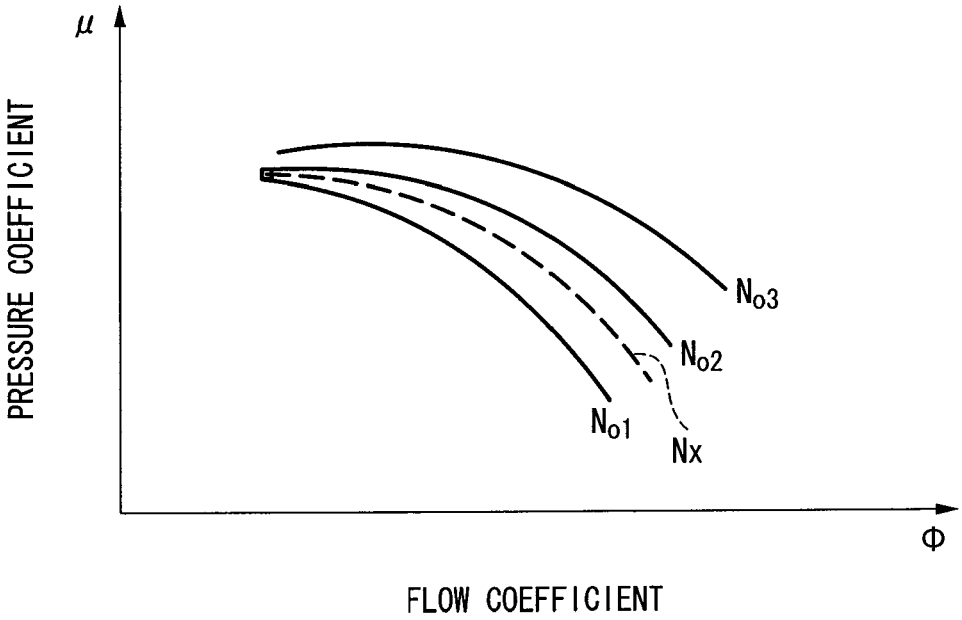
FIG. 5B shows another basic principle of a monitoring by the performance monitoring apparatus for the fluid machinery in accordance with the embodiment of the present invention.

FIG. 1 is a schematic diagram of a plant adopting a performance monitoring apparatus for fluid machinery in accordance with an embodiment of the present invention. FIG. 2 is a data flow diagram of the performance monitoring apparatus for the fluid machinery in accordance with the embodiment of the present invention. FIG. 3 is a calculation block diagram of the performance monitoring apparatus for the fluid machinery in accordance with the embodiment of the present invention. FIG. 4 is an example of a graph displayed by the performance monitoring apparatus for the fluid machinery in accordance with the embodiment of the present invention. FIGS. 5A and 5B show basic principles of a monitoring by the performance monitoring apparatus for the fluid machinery in accordance with the embodiment of the present invention.

First, a basic principle of a monitoring by the performance monitoring apparatus for the fluid machinery in accordance with the embodiment of the present invention shall be explained.

In the embodiment of the present invention, non-dimensional characteristics of a design performance (or a predicted performance) and a measured actual performance, comparing, and monitoring both the characteristics of a design performance and a measured actual performance is a basic principle.

Furthermore, it is possible to monitor more easily by calculating the rate of change (the rate of degradation) of the measured actual performance.

That is, a head, that is the amount of work per unit weight used for pressure rise of a compressor or the like effectively, is a parameter for monitoring the performance. A head (that is a predicted performance head $H_{pred}$), under a condition of predetermined suction temperature, specific heat ratio, constants of fluid, or the like, can be calculated from the following equation (1).

The predicted performance head:

$$H_{pred}=f_p(N, Q_S) \qquad \text{Equation (1)}$$

Here, N represents the rotating speed of the compressor or the like as a fluid control quantity, $Q_s$ represents an input volume flow.

In this case, the relationship between the predicted performance head $H_{pred}$ and the input volume flow $Q_s$ is, as shown in FIG. 5A, represented by a curve in which the predicted performance head $H_{pred}$ decreases as the input volume flow $Q_s$ increases at a plural fluid control quantities, that is, at each of the rotations. Here, when the rotating speed N increases to $N_{01}$, $N_{02}$, and $N_{03}$, the predicted performance head $H_{pred}$ increases.

A head (the measured actual performance head $H_{pred}$), that is a work load per unit weight flow under a condition such as a predetermined suction temperature, a property of gas, or the like, can be obtained from the following equation (2).

The measured actual performance head:

$$H_{real}=f_r(P_S, P_d, T_S) \qquad \text{Equation (2)}$$

Here, $P_s$ represents suction pressure, $P_d$ represents discharge pressure, and $T_s$ represents suction temperature.

Based on the predicted performance head $H_{pred}$, the rotating speed N, and the input volume flow $Q_s$, non-dimensional pressure coefficient μ and flow coefficient ϕ are calculated by the following equations (3) and (4) and stored as a database.

$$\text{The pressure coefficient: } \mu=2\,g\cdot H_{pred}/u^2=K_1\cdot(H_{pred}/N^2) \qquad \text{Equation (3)}$$

$$\text{The flow coefficient } \phi=Q_s/(60\,\pi\cdot D\cdot b\cdot u)=K_2\cdot(Q_2/N) \qquad \text{Equation (4)}$$

Here, u represents the circumferential speed of an impeller of the compressor, D represents the outer diameter of the impeller, b represents the width of an exit of the impeller, and $K_1$ and $K_2$ represent constants.

At this moment, the relationship between the pressure coefficient μ and the flow coefficient ϕ is, as shown in FIG. 5B, represented by a curve in which the pressure coefficient μ decreases after increasing as the flow coefficient ϕ increases. Curves representing the relationship between the pressure coefficient μ and the flow coefficient ϕ at a plural fluid control quantities, that is, at the rotating speed $N_{01}$, $N_{02}$, and $N_{03}$ are stored in the database.

The following calculations are performed based on the actual rotating speed $N_x$, the discharge pressure $P_d$, the suction pressure $P_s$, the suction temperature $T_s$, the input volume flow $Q_x$, the compression coefficient Z, the gas average molecular weight $M_W$, and the specific heat ratio k, which are actually measured.

A curve representing the relationship between the pressure coefficient μ and the flow coefficient ϕ at the actual rotating speed $N_x$ is, as shown in the dotted line in FIG. 5B, estimated by linear interpolation using the following equations (5) and (6).

$$\text{The pressure coefficient: } \mu=\{f_1(N_{02}, \phi)-f_1(N_{01}, \phi)\}/(N_{02}-N_{01})\cdot(N-N_{01})+f_1(N_{01}, \phi) \qquad \text{Equation (5)}$$

$$\text{The flow coefficient: } \phi=f_2(N_{02},\mu)-f_2(N_{01},\mu)/(N_{02}-N_{01})\cdot(N-N_{01})+f_1(N_{01},\mu) \qquad \text{Equation (6)}$$

By substituting the above-described pressure coefficient μ and the flow coefficient ϕ at the actual rotating speed $N_x$ in the equations (3) and (4), a curve, which is shown in the dotted line in FIG. 5A, representing the relationship between the predicted performance head $H_{pred}$ and the input volume flow $Q_s$ at the actual rotating speed $N_x$ is obtained from the following equations (7) and (8).

$$\text{The predicted performance head: } H_{pred}=1/K_1 \cdot N_x^2 \cdot \mu \quad \text{Equation (7)}$$

$$\text{The input volume flow: } Qs=1/K_2 \cdot N_x \cdot \phi \quad \text{Equation (8)}$$

The measured input volume flow $Q_x$ is modified to the input volume flow $Q_x$ under a predetermined condition based on the measured discharge pressure $P_d$, the suction pressure $P_s$, and the suction temperature $T_s$, which are actually measured. From the curve shown in FIG. 5A representing the relationship between the predicted performance head $H_{pred}$ and the input volume flow $Q_s$, a predicted performance head $H_{predx}$ at the actual rotating speed $N_x$ is obtained.

On the other hand, the measured actual performance head $H_{real}$ can be obtained from the following equation (9).

$$H_{real}=Z \cdot 1/\beta \cdot T_s/M_w \cdot \{(P_d/P_s)\ \beta-1\} \quad \text{Equation (9)}$$

Here, the compression coefficient is Z, the gas average molecular weight is $M_w$, and the specific heat ratio is k, and p represents (k−1)/k.

From the obtained predicted performance head $H_{predx}$ and the measured actual performance head $H_{real}$, a head ratio (a performance degradation) represented by α, which is equal to the measured actual performance head $H_{real}$ divided by the predicted performance head $H_{predx}$, is calculated, thereby the performance of equipment is monitored as the performance degradation.

Next, an overview shall be described of a plant adopting the performance monitoring apparatus for the fluid machinery in accordance with the embodiment of the present invention using the above-described principles with reference to FIG. 1.

In a thermal power plant and other various plants, a plural fluid machineries 1*a*, 1*b*, and 1*c* such as various fans, compressors, pump, or the like is provided. In a case in which the fluid machinery 1*a* is a compressor, a compressor 3 is driven by a variable speed controlled turbine 2.

The rotating speed of the turbine 2 is controlled by a governor (not shown). A r speed sensor 4 is connected to the turbine 2 for detecting the actual rotating speed $N_x$ of the turbine 2.

A discharge pressure sensor 5 for detecting the discharge pressure $P_d$ is provided in the discharge pipe of the compressor 3.

Furthermore, a suction pressure sensor 6 for detecting the suction pressure $P_s$, a suction thermometer 7 for detecting the suction temperature $T_s$ of a fluid flowing in the suction pipe 10, and a flowmeter 8 for detecting the input volume flow $Q_x$ of a fluid are provided in the suction pipe 10 of the compressor 3.

The actual rotating speed $N_x$ detected by the speed sensor 4, the discharge pressure $P_d$ detected by the discharge pressure sensor, the suction pressure $P_s$ detected by the suction pressure sensor 6, the suction temperature $T_s$ detected by the suction thermometer 7, and the input volume flow $Q_x$ detected by the flowmeter 8 are transmitted to a monitoring apparatus 11.

Fluid properties flowing in the suction pipe 10 are input and stored into the monitoring apparatus 11 or the central monitoring computer 13 and the like by other ways. Each of the measured values input into each of the monitoring apparatuses 11 for a preset period such as the actual rotating speed $N_x$, the discharge pressure $P_d$, the suction pressure $P_s$, the suction temperature $T_s$, the input volume flow $Q_s$, gas properties (compression coefficient Z, gas average molecular weight $M_w$, and the specific heat ratio k) is stored in a storage device in each of the monitoring apparatuses 11 together with identification codes for each of the fluid machineries 1*a*, 1*b*, and 1*c* and information on the measured time, day, month, and year.

Each of the identification codes stored in the storage device, information on time, day, month, and year when measured, and measured values are transmitted to the central monitoring computer 13 via a network 12 periodically or in accordance with a request from the central monitoring computer 13.

As a method of inputting, calculating, extrapolating, and storing properties, the following methods can be used.

Example 1 periodically measures the gas composition using a gas analyzer (not shown), inputs the gas composition into the central monitoring apparatus 11 or the central monitoring computer 13 (for example, Nitrogen; 79%, Oxygen 21% for the case of an air), estimates and stores the gas properties (the compression coefficient Z, the specific heat ratio k, and the gas average molecular weight $M_w$) from a reference pressure or a reference temperature in the monitoring apparatus 11, the central monitoring computer 13, or the like.

Example 2 measures only the gas molecular weight $M_w$ out of the gas properties periodically using a gas density meter not shown (density of the gas relative to the air) and uses only the gas molecular weight as a variable data when the compression coefficient Z and the specific heat ratio k are substantially constant relative to fluctuation of the gas composition.

Example 3 measures the gas composition offline by a gas analyzer (not shown), estimates the gas properties (the compression coefficient Z, the specific heat ratio k, and the gas average molecular weight $M_w$) of the measured gas by a gas property estimating program, inputs those values into the monitoring apparatus 11, the central monitoring computer 13, or the like and use them.

The central monitoring computer 13 is, as shown in FIG. 2, provided with a operating data collector 20, a shared memory 21, a performance monitoring calculator 22, a data collection device 23, a predicted performance curve calculator 24, a performance monitoring database 25, a performance drop rate calculator 26, a historical database 27, and a display device 28.

Here, these calculators are usually computer programs or sequence blocks but are not limited thereto but are also formed of each of the electric calculation circuit units or the like.

Next, processing by each of the calculators or the like shall be described referring to FIG. 3.

First, an initialization of communication is performed in the operating data collector 20 (step S01).

Time is counted by a timer, and a request signal is periodically transmitted relative to each of the monitoring apparatuses 11 (step S02).

When the identification codes for each of the fluid machineries 1*a*, 1*b*, and 1*c*, information on measured time, day, month, and year for a predetermined period, and measured values are input from each of the monitoring apparatuses 11 (step S03), the data is copied to the shared memory 21 (step S04). Thereafter, the timer is reset, and goes back to the time counting by the timer (step S02).

On the other hand, from the data collection device 23, capacities, performances, or the like of each of the fluid machineries 1*a*, 1*b*, and 1*c* are input per identification code.

The input capacities, performances, or the like are nondimensionalized by the equations (3) and (4), as shown in FIG. 5B for example, curves are obtained showing the relationship between the pressure coefficient μ and the flow coefficient ϕ at predetermined rotation speed such as at 3 rotation speeds $N_{01}$, $N_{02}$, and $N_{03}$ by the predicted performance curve calculator 24. The obtained curves showing the relationship between the pressure coefficient μ and the flow coefficient ϕ are stored in the performance monitoring database 25 with the identification codes of each of the fluid machineries 1*a*, 1*b*, and 1*c* and names of the apparatuses.

In the performance monitoring calculator 22, first, an initialization of a performance monitoring program is performed (step S11).

Time is counted by the timer (step S12), the measured date of the fluid machinery (the identification code, the measured time, day, month, and year, the actual rotating speed $N_x$, the discharge pressure $P_d$, the suction pressure $P_s$, the suction temperature $T_s$, the input volume flow $Q_s$, the compression coefficient Z, the gas average molecular weight $M_w$, the specific heat ratio k, or the like) is periodically obtained from the shared memory 21 (step S13).

In accordance with the input data, the measured actual performance head $H_{real}$ is calculated from the equation (9).

On the other hand, based on the measured actual rotating speed $N_x$, the discharge pressure $P_d$, the suction pressure $P_s$, the suction temperature $T_s$, the input volume flow $Q_x$, the compression coefficient Z, the gas average molecular weight $M_w$, and the specific heat ratio k, the predicted performance head $H_{predx}$ at the actual rotating speed $N_x$ of the fluid machinery at the time of the measurement is calculated from the equations (5) to (8) and curves showing the relationship between the predicted performance head $H_{pred}$ and the input volume flow $Q_s$ shown in FIG. 5A.

The head ratio (the performance degradation) represented by α, which is equal to the measured actual performance head $H_{real}$ divided by the predicted performance head $H_{predx}$, is calculated (step S14) and is output into the historical database 27 (step S15).

Thereafter, the timer is reset, and goes back to the time counting by the timer (step S12).

In the performance drop rate calculator 26, the head ratio a is input from the historical database 27, differentiated and the rate of change is obtained. The obtained rate of change is stored in the historical database 27.

In the display device 28, first, an initialization of a screen display program is performed (step S21).

From the historical database 27, the head ratio a and the rate of change of the head ratio a are obtained, a screen data is formed (step S22), the graph shown in FIG. 4 is displayed on the screen (step S23).

The graph displayed on the screen, as shown in FIG. 4, shows fluctuation of the head ratio (the performance degradation) α (or the measured actual performance head $H_{real}$) and the rate of change of the head ratio α with a horizontal axis representing time. In accordance with that, it is possible to easily monitor the performance of the compressor 3. Also, it is possible to monitor a performance degradation of the equipments very easily, predict maintenance timing, and prevent future troubles from happening.

In the above described case, the fluid machinery is driven by generating machinery (a gas turbine, a vapor turbine, and motors such as electric motors), whose rotating speed is variable, and the rotating speed thereof is controlled. The rotating speed is the fluid control quantities.

However the fluid control quantities are not limited thereto.

For example, the rotating speed of the fluid machinery is made constant, an inlet guide vane (IGV) or a flow control valve is provided at the inlet of the fluid machinery, and the inlet guide vane or the flow control valve may be controlled as the fluid control quantities.

Although the embodiment of the present invention in the case of a compressor is described above, the embodiment is available to other fans, a pump, or the like. The present invention is not limited to the embodiment described above but various changes and modification are possible based on design requirements and the like, provided they do not depart from the gist of the present invention.

INDUSTRIAL APPLICABILITY

In accordance with the performance monitoring apparatus for the fluid machinery in accordance with the present invention, it is possible to easily monitor the performance degradation of the fluid machinery by a predicted performance curve calculator by: non-dimensional characteristics per a plural fluid control quantities from a compression ratio or a pressure difference and an input flow rate of the fluid machinery; obtaining the curve representing the relationship between the pressure coefficient and the flow coefficient; obtaining the measured actual performance head from fluid control quantities, the suction pressure, the discharge pressure, the suction temperature, the compression coefficient, the gas average molecular weight, and the specific heat ratio at the running time of the fluid machinery; obtaining the predicted performance head from a predicted performance curve, fluid control quantities at the running time of the fluid machinery, and an input flow rate; and being provided with a performance monitoring calculator for calculating the performance degradation from the ratio of the obtained predicted performance head and the measured actual performance head.

What is claimed is:

1. A performance monitoring apparatus for fluid machinery comprising:

a predicted performance curve calculator, and a performance monitoring calculator, wherein the predicted performance curve calculator obtains a curve representing the relationship between pressure coefficients and flow coefficients by non-dimensional characteristics per a plural fluid control quantities from compression ratio or pressure difference, and input flow rate of the fluid machinery, the performance monitoring calculator obtains:

a measured actual performance head from fluid control quantities including, suction pressure, discharge pressure, suction temperature, the compression coefficient, gas average molecular weight, and the specific heat ratio while the fluid machinery is running;

a predicted performance head from a predicted performance curve, fluid control quantities, and an input flow rate; and calculates a performance degradation from the ratio of the predicted performance head to the measured actual performance head, and wherein the measured actual performance head $H_{real}$ is obtained from the following equation:

$$H_{real}=Z\cdot 1/\beta\cdot T_s/M_w\cdot\{(P_d/P_s)\ \beta-1\}$$

here, $P_s$ represents suction pressure, $P_d$ represents discharge pressure, $T_s$ represents suction temperature, Z represents the compression coefficient, $M_w$, represents gas average molecular weight, and k represents specific heat ratio, and β equals (k−1)/k.

2. The performance monitoring apparatus for fluid machinery according to claim 1, further comprising:

a performance drop rate calculator for calculating a rate of change of the performance degradation by differentiating the performance degradation.

3. A performance monitoring system for fluid machinery comprising:

a monitoring apparatus for measuring or calculating suction pressure, discharge pressure, suction temperature, the compression coefficient, gas average molecular weight, and the specific heat ratio while the fluid machinery is running, and storing the data, and a central monitoring computer for receiving the data stored in the monitoring apparatus via a network, wherein the central monitoring computer is provided with the performance monitoring apparatus for fluid machinery according to claim 2.

4. A performance monitoring system for fluid machinery comprising:

a monitoring apparatus for measuring or calculating suction pressure, discharge pressure, suction temperature, the compression coefficient, gas average molecular weight, and the specific heat ratio while the fluid machinery is running, and storing the data, and a central monitoring computer for receiving the data stored in the monitoring apparatus via a network, wherein the central monitoring computer is provided with the performance monitoring apparatus for fluid machinery according to claim 1.

* * * * *